US005707246A

United States Patent [19]

Perkins

[11] Patent Number: 5,707,246

[45] Date of Patent: Jan. 13, 1998

[54] SECURITY DEVICE FOR LAMP ADAPTOR

[75] Inventor: Rick A. Perkins, Holland, Mich.

[73] Assignee: Progressive Technology in Lighting, Inc., Holland, Mich.

[21] Appl. No.: 590,056

[22] Filed: Jan. 16, 1996

[51] Int. Cl.[6] ..... H01R 4/50

[52] U.S. Cl. ..... 439/339; 439/133; 439/236

[58] Field of Search ..... 439/133, 226, 439/232, 233, 236, 306, 360, 642, 645, 646, 339, 340

[56] References Cited

U.S. PATENT DOCUMENTS

| | | | |
|---|---|---|---|
| 1,080,327 | 12/1913 | Chapman et al. . | |
| 1,110,193 | 9/1914 | Dougherty . | |
| 1,239,005 | 9/1917 | Harris et al. . | |
| 1,287,449 | 12/1918 | Ryder . | |
| 1,583,313 | 5/1926 | Robertson . | |
| 1,593,534 | 7/1926 | Kuhlman . | |
| 1,632,599 | 6/1927 | Hayward . | |
| 1,640,128 | 8/1927 | Kovanda . | |
| 1,644,767 | 10/1927 | Zimmermann . | |
| 1,761,344 | 6/1930 | Huber . | |
| 1,777,187 | 9/1930 | Wayland . | |
| 1,790,239 | 1/1931 | Lawson . | |
| 1,898,498 | 2/1933 | Pokorney . | |
| 2,004,550 | 6/1935 | Bradley . | |
| 2,071,769 | 2/1937 | Schlicker et al. . | |
| 2,372,266 | 3/1945 | Frank . | |
| 2,494,755 | 1/1950 | Grover . | |
| 2,648,049 | 8/1953 | Brayman et al. . | |
| 2,835,878 | 5/1958 | Bauer et al. . | |
| 3,165,370 | 1/1965 | Laub, Sr. . | |
| 3,504,329 | 3/1970 | Peterson et al. . | |
| 3,611,258 | 10/1971 | Kolakowski . | |
| 3,676,835 | 7/1972 | Holly . | |
| 3,885,185 | 5/1975 | Tilley . | |
| 4,886,994 | 12/1989 | Ragge, Jr. . | |
| 4,936,789 | 6/1990 | Ugalde | 439/236 |
| 5,006,751 | 4/1991 | Marshall . | |
| 5,044,974 | 9/1991 | Pelton et al. . | |
| 5,171,292 | 12/1992 | Ortiz . | |
| 5,286,216 | 2/1994 | Volz | 439/236 |

*Primary Examiner*—Khiem Nguyen
*Attorney, Agent, or Firm*—Van Dyke, Gardner, Linn & Burkhart, LLP

[57] ABSTRACT

A lamp adaptor for adapting a lamp to an incandescent lamp socket includes a body and a contact assembly. The body includes an electrical circuit for converting incandescent lamp electrical supply levels to electrical supply levels of the lamp. The contact assembly is connected with the electrical circuit and configured to threadably connect with an incandescent lamp socket by rotating the contact assembly in a forward radial direction. The contact assembly includes a conducting screw shell that is configured to threadably engage in an incandescent lamp socket, a support defined by the body for the screw shell, and a ratchet coupling the screw shell with the support. The rachet provides a grip between the screw shell and the support when the contact assembly is rotated in the forward radial direction. The ratchet provides substantially free rotation between the screw shell and the support when the contact assembly is rotated in a rearward radial direction in order to prevent unauthorized removal of the lamp adaptor from an incandescent lamp socket. A removal tool is provided to engage the contact assembly in a manner that provides a grip between the screw shell and the support in order to allow removal of the lamp adaptor from an incandescent lamp socket.

6 Claims, 3 Drawing Sheets

SECURITY DEVICE FOR LAMP ADAPTOR

BACKGROUND OF THE INVENTION

This invention relates generally to lamp adaptors for adapting non-incandescent lamps for use in incandescent lamp sockets. In particular, the invention relates to a security device for resisting unauthorized removal of lamp adaptors once inserted in an incandescent socket. The invention is useful for lamp adaptors for various types of lamps, including compact fluorescent, quartz halogen, various high efficiency gas discharge lamps, and the like.

In order to reduce the electrical energy consumed by lighting appliances, a concerted effort has been underway to replace inefficient incandescent lamps with high efficiency lamps, such as compact fluorescent lamps and the like. Because of different electrical power source requirements, it is necessary to provide an electrical adaptor in order to adapt the high voltage AC supplied to incandescent lamps to the electrical supply requirements of the particular high efficiency lamp being substituted for the incandescent lamp. Such adaptor typically includes a screwshell connector, commonly known as an "Edison base," for threadable interconnection with the incandescent socket, and a housing containing conversion circuitry for converting high voltage electrical power source to the power requirements of the substitute lamp. If the adaptor is for use with a separate lamp, the adaptor additionally includes electrical contacts for making electrical interconnection with the lamp. However, the lamp and adaptor may be supplied as an integral unit in which case, the lamp would be permanently electrically connected with the conversion circuitry.

Such lamp adaptor is typically relatively expensive when compared with the cost of the incandescent bulb it is replacing. As such, it is desireable to provide an anti-theft device in order to attempt to prevent unauthorized removal of the adaptor once inserted in the incandescent lamp socket in publicly accessable locations, such as hotel rooms and the like. In an exceptionally commercially successful anti-theft device developed by, and marketed by, the present assignee, an Edison base is provided having a screwshell which is freely rotatably about a base. A tool is provided for insertion between the screwshell and the base in order to provide frictional coupling between the two. In this manner, by insertion of the tool into the adaptor, the Edison base may be rotatably inserted into an incandescent lamp socket. The tool subsequently removed which provides free rotation between the adaptor base and the screwshell. This avoids removal of the adaptor because rotation of the housing is not translated to the screwshell. Therefore, the screwshell is not unthreaded from the incandescent lamp socket. In order to remove the adaptor, the tool is reinserted therein in order to frictionally couple the base with the screwshell, allowing the screwshell to be rotated out of the lamp socket.

Another type of Edison base useful in the industry is a forward-ratcheting base. The forward-ratcheting base provides limited frictional engagement between the screwshell and the base in order to rotate the screwshell into the lamp socket. Once the Edison base is fully seated therein, further forward rotation of the adaptor overcomes the resistance between the screwshell and the base and allows further rotation of the adaptor. This feature allows the adaptor body to be radially positioned with respect to the lamp socket. This is especially useful for application to table lamps and the like having shade-supporting harps, in order to allow the adaptor to be suitably positioned for being straddled by the harp. Such forward-ratcheting adaptor includes a forward-ratcheting device which accommodates limited forward rotational motion between the adaptor and the screwshell. However, the forward-ratcheting device resists relative motion between the base and the screwshell in the reverse direction, which is the direction of rotation for unthreading the adaptor from the socket. This allows the adaptor to be readily removed from the socket even if the Edison base is well seated in the socket. However, such forward-ratcheting Edison base provides no security feature and is, therefore, useful primarily in locations not accessible to the general public, such as in home applications, and the like.

SUMMARY OF THE INVENTION

The present invention provides a security device for a lamp adaptor which is a significant improvement over the security device developed by the present assignee. According to the invention, an Edison base for a lamp adaptor includes a screwshell contact, a support for the screwshell connector, and a ratcheting device selectively coupling the screwshell connector with the support. The ratcheting device is configured to rachet in a reverse rotational direction. More particularly, in order to threadably insert the Edison base into a lamp socket, the reverse-ratcheting device provides a positive coupling between the screwshell and the support in order to allow the screwshell to be threadably inserted by rotation of the support. However, any attempts to rotate the support in a reverse direction, in order to remove the adaptor from the socket, causes a relatively free movement between the support and the screwshell. This resists the ability to remove the adaptor from the socket. In order to remove the adaptor from the socket, a tool is provided for insertion in the adaptor in order to provide frictional engagement between the screwshell and the support. In this manner, the tool must be inserted into the adaptor in order to allow the screwshell to be unthreaded from the socket to remove the adaptor from the lamp shell.

The present invention provides a security device for a lamp adaptor which is significantly easier to use than prior security devices. The lamp adaptor may be engaged with the incandescent lamp socket without the use of a tool. This greatly facilitates the ease of conversion of incandescent lamps to high efficiency lamps because the step of inserting the tool into the adaptor is avoided. Furthermore, there is no need for the technician to remember to include a tool when endeavoring to install an adaptor. However, once installed, the adaptor cannot be removed from the incandescent lamp socket without the use of a tool. Therefore, anti-theft security is provided.

These and other objects, advantages, and features of this invention will become apparent upon review of the following specification in conjunction with the drawings.

DESCRIPTION OF THE PREFERRED EMBODIMENT

Figure 1:
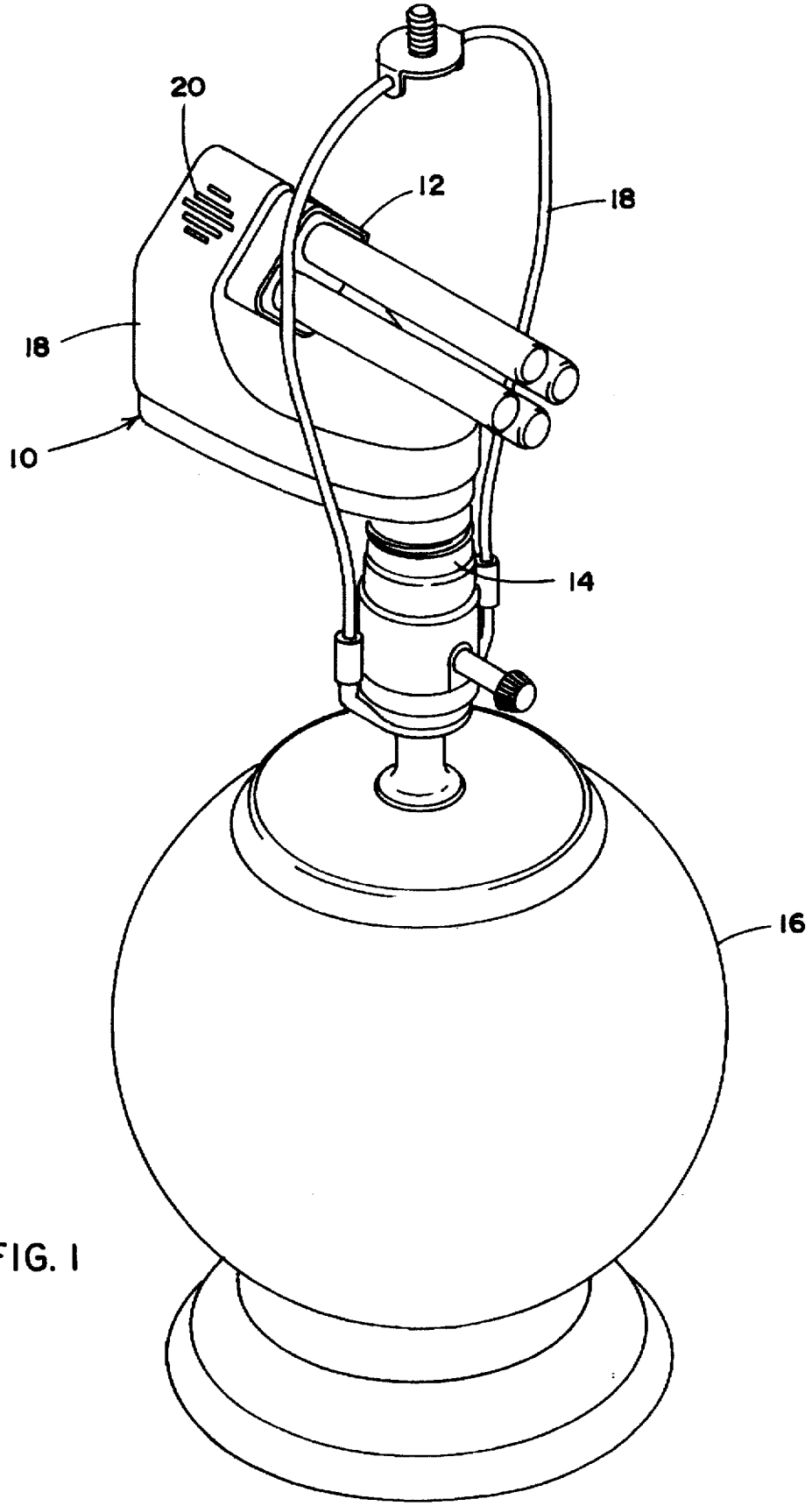
FIG. 1 is a perspective view of a lamp adaptor according to the invention in its intended environment.

Referring now specifically to the drawings and the illustrative embodiments depicted therein, a lamp adaptor 10, according to the invention, is provided to adapt a lamp 12 for use with an incandescent lamp socket 14 (FIG. 1). In the illustrated embodiment, incandescent lamp socket 14 is a part of a table lamp 16 having a harp 18 for holding a lampshade (not shown). However, the invention is applicable for use with other incandescent lamp fixtures including built-in recessed lighting fixtures, surface-mounted lighting fixtures, lighted signs, and the like. In the illustrated embodiment, lamp 12 is a high efficiency compact fluorescent lamp. However, the invention may be useful with other lamps such as quartz halogen, other gas discharge lamps, tungsten filament lamps, and the like. Lamp adaptor 10 includes a housing, or body, 18 enclosing electrical circuitry for converting incandescent lamp voltage such as 110 volts/220 volts AC to the electrical supply requirements of lamp 12, as is well known in the art. Examples of such circuitry include electronic ballasts, magnetic ballasts, and the like. Because such circuitry (not shown) typically generates heat, ventilating louvers 20 are provided in housing 18.

Figure 2:
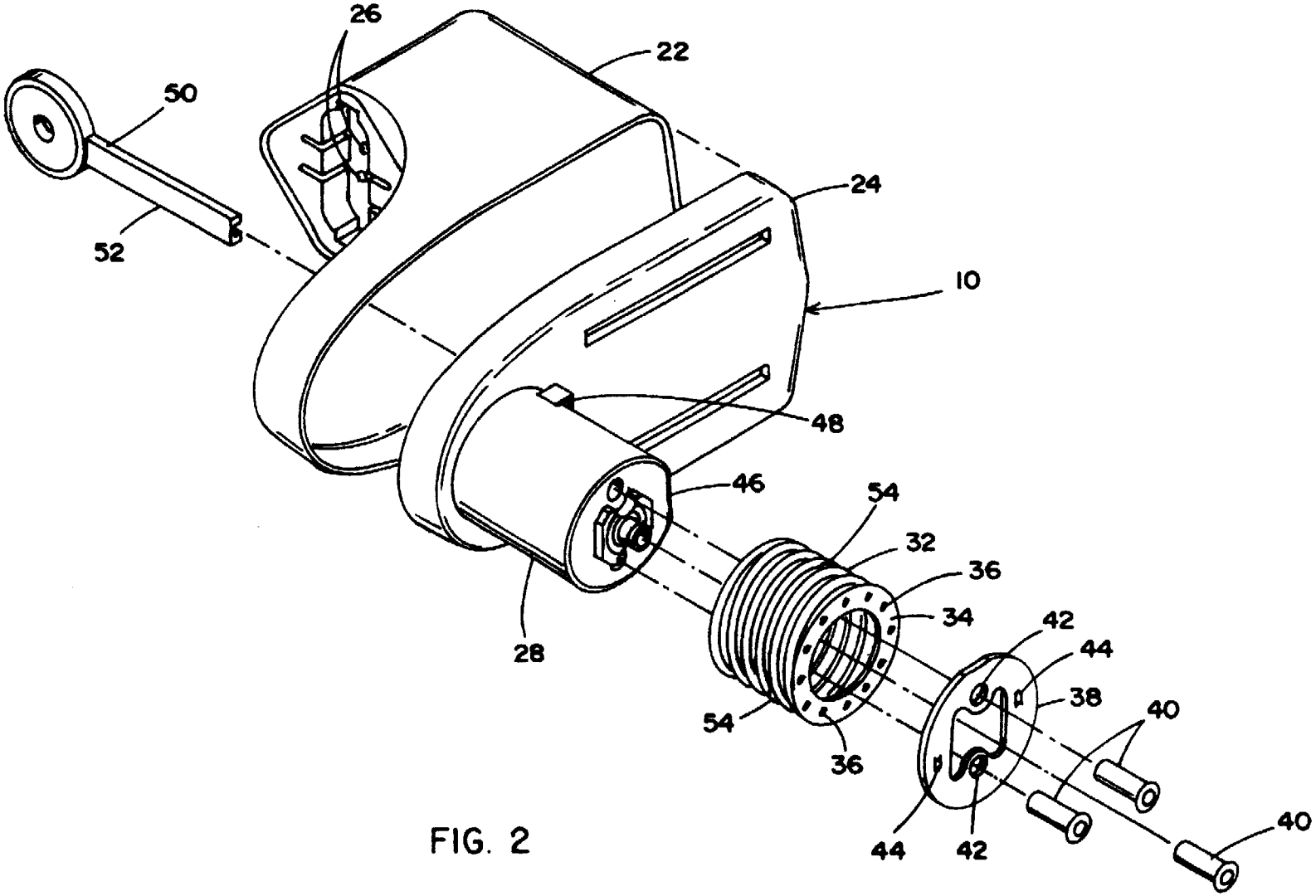
FIG. 2 is an exploded perspective view of a lamp adaptor according to the invention.

Housing 18 is divided into an upper portion 22 and a lower portion 24 (FIG. 2). Upper portion 22 contains a pair of electrical contacts 26 for supplying electrical energy from the conversion circuitry to mating contacts (not shown) on lamp 12. Alternatively, lamp 12 could be integrally formed with housing 18, in which embodiment, no contacts 26 would be required because the circuitry would be hard-wired with the lamp. An electrical connector assembly 30 is attached to lower housing portion 24 in order to provide electrical interconnection with incandescent lamp socket 14. Electrical connector assembly 30, which is electrically connected with the conversion circuitry, includes a support 28, which is attached to lower portion 24 of the housing and a screwshell 32 which has an inner diameter that is slightly larger than the outer diameter of support 28. Screwshell 32 includes a lower disk 34 having a plurality of detents, 36, formed therein. A disk 38, which retains screwshells on support 28, is attached to the support by a pair of rivets 40 extending through opening 42 in disk 38. A rivet 42, which is electrically isolated from screwshell 32, is connected with support 28 for the purpose of providing a central contact for electrical connector 30 as is known in the art.

Disk 38 includes a pair of tabs, or barbs, 44 which extend in the direction of disk 34. Barbs 44 are oriented in a particular fashion with respect to screwshell 32 in order to allow relative radial movement between disks 34 and 38 in one radial direction and not in the opposite radial direction. In one radial direction, the barbs pass over detents 36 without engaging them. In the opposite radial direction, barbs 44 engage a pair of detents 36, whereby relative motion in said opposite direction is prevented. Because disk 38 is rigidly attached to support 28, engagement between barbs 44 and detents 36 prevents rotation of screwshell 32 in that direction. In this manner, disks 34 and 38 provide a ratchet, which allows screwshell 32 to freely rotate in one radial direction but not in the opposite radial direction.

Figure 3:
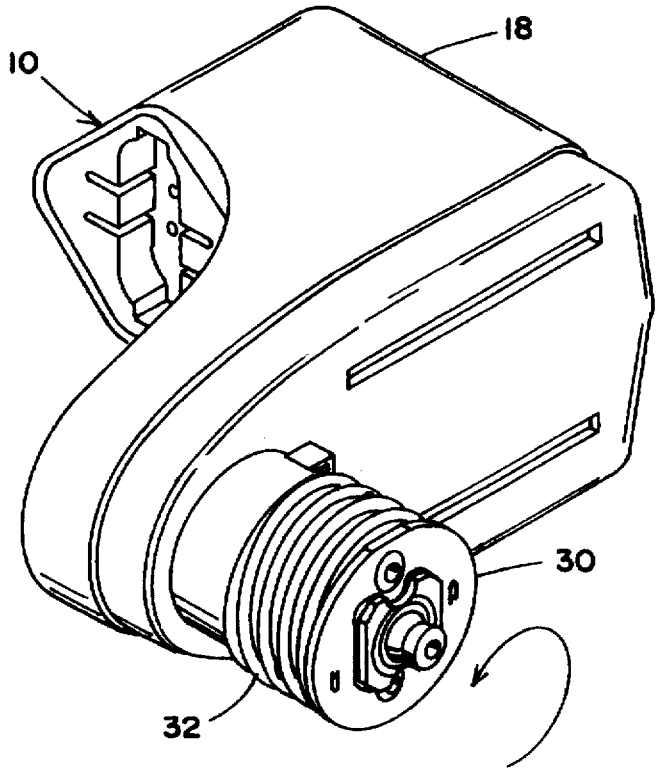
FIG. 3 is a perspective view of a lamp adaptor being inserted in an incandescent lamp socket.
Figure 4:
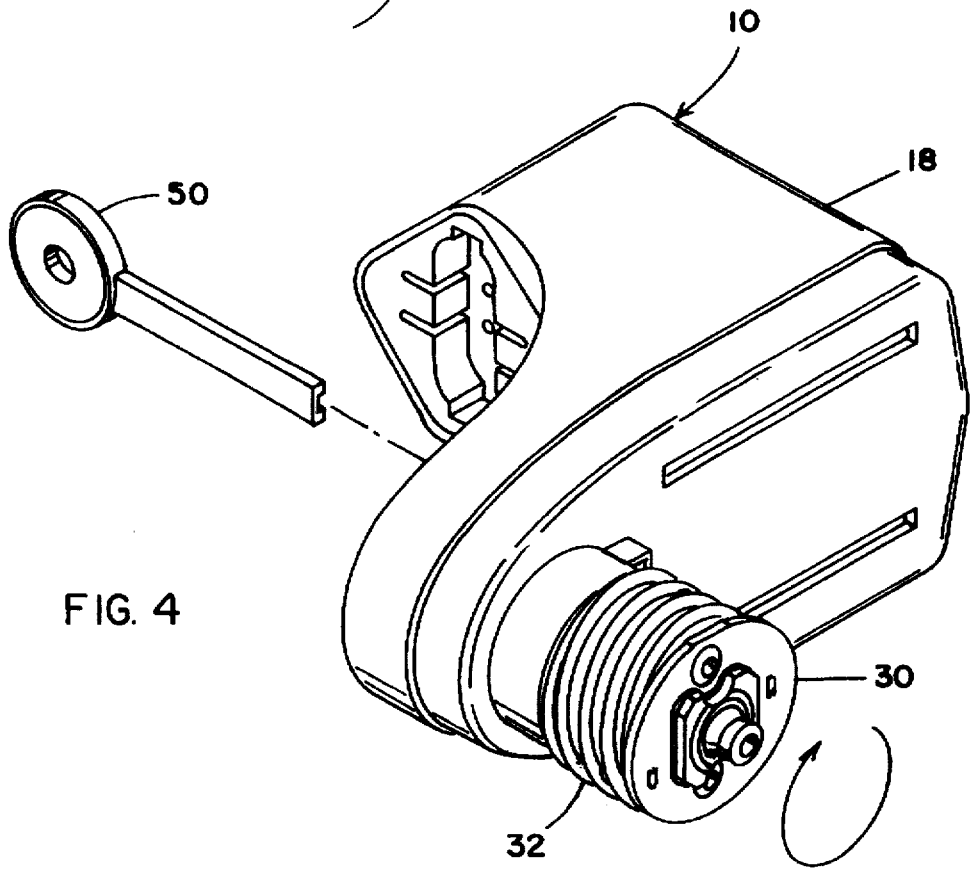
FIG. 4 is a perspective view of a lamp adaptor being removed from an incandescent lamp socket.

As best seen by reference to FIG. 3, screwshell 32 is prevented from rotation when connector 30 is rotated in the direction indicated by the arrow. The indicated direction is the radial direction required for threadably inserting connector 30 into incandescent lamp socket 14. In this manner, rotation of housing 18, and thereby connector 30, provides a positive force upon screwshell 32 which threads the screwshell into the incandescent lamp socket. However, rotation of the connector 30 in the opposite direction, as illustrated in FIG. 4, allows free rotation of screwshell 32 with respect to housing 18. Therefore, lamp adaptor 10 cannot be removed from the incandescent lamp socket because the force of rotation of housing 18 is not coupled to screwshell 32. Therefore, screwshell 32 remains threadably engaged with lamp socket 14. As best seen by reference to FIG. 2, support 28 includes a flat surface 46 which is aligned with an opening 48 in lower housing 24 which is aligned with an opening (not shown) in upper housing portion 22. A removal tool 50 having a stem 52 which is configured to pass through opening 48 and be wedged between flat surface 46 and the interior of screwshell 32 is provided. When removal tool 50 is inserted through opening 48, stem 52 provides frictional coupling between screwshell 32 and support 28. Therefore, with the removal tool inserted in adaptor 10, rotational motion of adaptor 18 with respect to the incandescent lamp socket is coupled to screwshell 32 in both radial directions of motion. Accordingly, with removal tool 50 inserted in adaptor 10, adaptor 10 may be removed from the incandescent lamp socket.

It is thus seen that lamp adaptor 10 may be inserted into an incandescent lamp socket without the requirement of a special tool. This avoids the necessity for the extra step of inserting the tool into the lamp adaptor as well as the possibility that such tool could inadvertently be left in the adaptor by an inexperienced technician. However, security is provided because, without the removal tool, the adaptor cannot be removed from the incandescent lamp socket because the screwshell cannot be unthreaded from the lamp socket. Insertion of the removal tool provides ready removal of the adaptor. In a preferred form, the threads of screwshell 32 are deformed at 54. This deformation is sufficient to allow the screwshell to be threaded into an incandescent lamp socket, but creates increased friction tending to retain the screwshell engaged in the lamp socket. This further enhances the security features of the invention by making it more difficult to remove the adaptor unless the removal tool 50 is inserted therein.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. A lamp adaptor for adapting a lamp to an incandescent lamp socket, comprising:

a body including an electrical circuit for converting incandescent lamp electrical supply levels to electrical supply levels of a lamp; and a contact assembly connected with said electrical circuit and configured to threadably connect with an incandescent lamp socket by rotating said contact assembly in a forward radial direction; said contact assembly including a conducting screwshell that is configured to threadably engage an incandescent lamp socket, a support defined by said body for said screwshell and a ratchet coupling said screwshell with said support, said ratchet providing a grip between said screwshell and said support when said contact assembly is rotated in said forward radial direction and said ratchet providing substantially free rotation between said screwshell and said support when said contact assembly is rotated in a rearward radial direction to prevent unauthorized removal of the lamp adaptor from an incandescent lamp socket.

2. The lamp adaptor in claim 1 including a removal tool that is configured to engage said contact assembly in a manner that provides a grip between said screwshell and said support in order to allow removal of the lamp adaptor from an incandescent lamp socket.

3. The lamp adaptor in claim 1 wherein said ratchet includes a first disk defining a plurality of detents attached to said screwshell and a second disk defining at least one barb attached to said support and engaging said first disk, said at least one barb oriented to engage one of said detents when said contact assembly is rotated in said forward radial direction and to glide over said detents when said contact assembly is rotated in said rearward radial direction.

4. The lamp adaptor in claim 2 wherein said support includes a portion spaced inwardly from said screwshell and wherein said tool is configured to be positioned between said portion and said screwshell and to thereby frictionally couple said support and said screwshell.

5. The lamp adaptor in claim 1 wherein said screwshell includes threads that are deformed from the mirror image of lamp socket threads in order to further retain said screwshell in a lamp socket.

6. A method of adapting a lamp to an incandescent lamp socket, including:

providing a lamp adaptor having a body including an electrical circuit for converting incandescent lamp electrical supply levels to electrical supply levels of a lamp; a contact assembly configured to threadably connect with an incandescent lamp socket by rotating said contact assembly in a forward radial direction, wherein said contact assembly is rotatable in a forward direction for connecting with an incandescent lamp socket and is not rotatable in a reverse radial direction in order to prevent unauthorized removal of the lamp adaptor from an incandescent lamp socket;

rotating said contact assembly in said forward radial direction without engaging said contact assembly with a tool in order to connect said lamp adaptor with an incandescent lamp socket; and rotating said contact assembly in said rearward radial direction by engaging said contact assembly with a tool that is configured to engage said contact assembly in a manner that makes said contact assembly rotatable in said reverse radial direction in order to remove said lamp adaptor from said incandescent lamp socket.

* * * * *